US008122864B2

(12) United States Patent
Randall et al.

(10) Patent No.: US 8,122,864 B2
(45) Date of Patent: Feb. 28, 2012

(54) INTAKE MANIFOLD FOR MULTICYLINDER INTERNAL COMBUSTION ENGINE

(75) Inventors: Katherine Jane Randall, Dearborn Heights, MI (US); Christopher William Newman, Farmington Hills, MI (US); Todd Brewer, Dearborn, MI (US)

(73) Assignee: Ford Global Technologies, Dearborn, MI (US)

( * ) Notice: Subject to any disclaimer, the term of this patent is extended or adjusted under 35 U.S.C. 154(b) by 455 days.

(21) Appl. No.: 12/470,547

(22) Filed: May 22, 2009

(65) Prior Publication Data

US 2010/0294225 A1 Nov. 25, 2010

(51) Int. Cl.
*F02M 35/10* (2006.01)

(52) U.S. Cl. ..... 123/184.21; 123/184.37; 123/184.49; 123/184.24; 123/184.25; 123/184.34

(58) Field of Classification Search . 123/184.21–184.61
See application file for complete search history.

(56) References Cited

U.S. PATENT DOCUMENTS

| | | | | |
|---|---|---|---|---|
| 4,180,041 | A | 12/1979 | Miyazaki et al. | |
| 4,819,953 | A | 4/1989 | Joh | |
| 5,107,804 | A | 4/1992 | Becker et al. | |
| 5,145,190 | A | 9/1992 | Boardman | |
| 5,267,543 | A | 12/1993 | Novak et al. | |
| 5,280,769 | A | 1/1994 | Yates | |
| 5,657,725 | A | 8/1997 | Butterfield et al. | |
| 5,704,333 | A | 1/1998 | Okumura et al. | |
| 5,957,464 | A | 9/1999 | Elliott | |
| 6,055,806 | A | 5/2000 | Dalton | |
| 6,311,986 | B1 | 11/2001 | Richardson et al. | |
| 6,662,772 | B1 * | 12/2003 | Murphy | 123/184.21 |
| 6,763,802 | B1 | 7/2004 | Brassell | |
| 6,860,249 | B2 * | 3/2005 | Carpenter | 123/184.61 |
| 7,096,849 | B1 | 8/2006 | Mathis et al. | |
| 7,337,758 | B2 | 3/2008 | Sturdy et al. | |
| 2004/0134192 | A1 | 7/2004 | Umchara et al. | |
| 2005/0179215 | A1 | 8/2005 | Kono | |
| 2007/0017468 | A1 | 1/2007 | Letourneau et al. | |
| 2007/0017470 | A1 * | 1/2007 | Letourneau | 123/184.38 |
| 2008/0271697 | A1 | 11/2008 | Vichinsky | |

FOREIGN PATENT DOCUMENTS

JP 2002106428 A 4/2002

* cited by examiner

*Primary Examiner* — Michael Cuff
*Assistant Examiner* — James Kim
(74) *Attorney, Agent, or Firm* — Julia Voutyras; Jerome Drouillard

(57) ABSTRACT

An intake manifold for a multicylinder internal combustion engine includes a number of inlet runners operatively connected with a mounting flange. A sealing region circumscribes only an outer periphery of the mounting flange and does not extend between adjacent ones of the intake runners. The sealing region includes a continuous groove formed in the mounting flange and a sealing composition applied to the groove.

12 Claims, 2 Drawing Sheets

INTAKE MANIFOLD FOR MULTICYLINDER INTERNAL COMBUSTION ENGINE

CROSS REFERENCE TO RELATED APPLICATIONS

None.

BACKGROUND OF THE DISCLOSURE

1. Field of the Disclosure

The present disclosure relates to a manifold for conducting charge air to cylinders of an internal combustion engine.

2. Related Art

Intake manifolds have been used for many years with multicylinder internal combustion engines. Because air usually enters an engine at a single point, given that the mass flow of air through an engine must be known, so as to permit controlling the air fuel ratio correctly to promote proper post-combustion treatment of exhaust gases, manifolding is typically used. Engine designers have been very careful to seal around the various passages through an intake manifold at the point where the manifold is attached to the cylinder head of an engine, so as to prevent air from passing from one inlet runner to another. Unfortunately, such sealing is expensive in terms of materials and also may cause excess weight because the engine designers must assure that solid surfaces are available in connection with both the intake manifold and the mating cylinder head to support a sealing capability.

It would be desirable to provide an intake manifold system which does not need sealing between adjacent runners and which provides opportunity for weight reduction and material cost reduction.

SUMMARY

According to an aspect of the present disclosure, an intake manifold for a multicylinder internal combustion engine includes a number of inlet runners and a cylinder head mounting flange operatively connected with the runners, with a sealing region circumscribing only an outer periphery of the mounting flange. The sealing region does not extend between adjacent ones of the runners. In a preferred embodiment, the sealing region includes a continuous groove formed in the intake manifold's mounting flange, with a sealing composition applied to the groove. The sealing region may be configured as a continuous loop without cross-linking.

According to another aspect of the present disclosure, a sealing composition used with the present intake manifold may include either a pre-formed elastomeric gasket or a formed-in-place elastomeric gasket, or yet other types of gaskets known to those skilled in the art and suggested by this disclosure.

According to another aspect of the present disclosure, a sealing composition applied as a continuous loop to an outer periphery of the mounting flange prevents leakage of air past the mounting flange and into the engine, while permitting some air exchange between adjacent ones of the manifold's inlet runners.

According to another aspect of the present disclosure, an intake manifold may include a number of relief regions configured in a mounting flange and a cylinder head of the engine, with the relief regions being positioned between adjacent ones of the inlet runners.

It is an advantage of an intake manifold according to the present disclosure that a reduction in material cost, in the form of sealants and gaskets, is achieved, while at the same time reducing processing costs by removing the need for milling or machining a gasket groove between adjacent runners on the intake manifold's mounting flange.

It is yet another advantage of an intake manifold according to the present disclosure that weight savings are possible because intake manifold and cylinder head material is eliminated by creating weight and material saving voids extending partially between adjacent runners of the intake manifold and ports of the cylinder head.

Other advantages, as well as features of the present system, will become apparent to the reader of this specification.

DETAILED DESCRIPTION OF THE PREFERRED EMBODIMENTS

Figure 1:
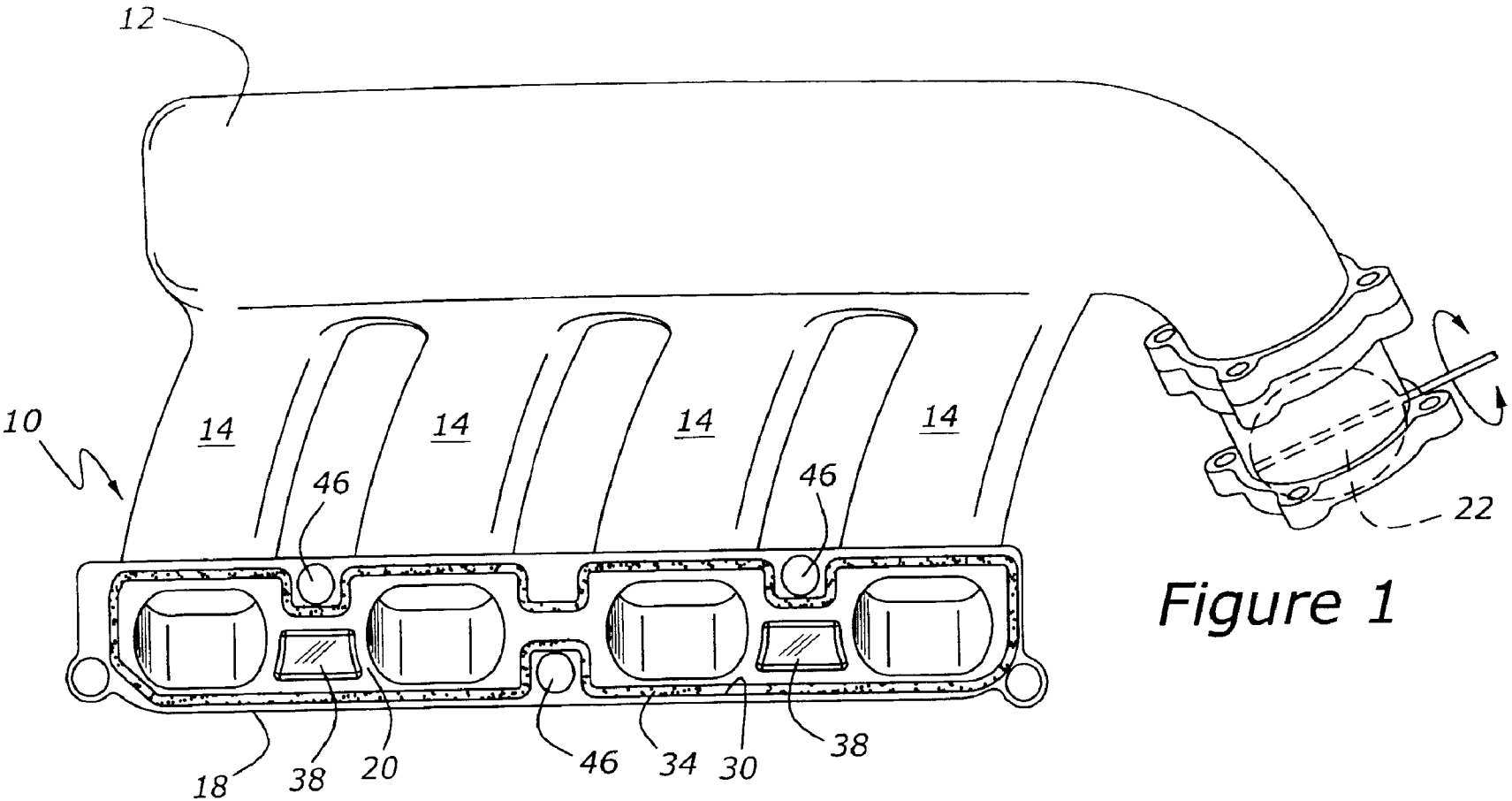
FIG. 1 is a partially schematic representation of an intake manifold according to an aspect of the present disclosure.

As shown in FIG. 1, an intake manifold, 10, has a plenum, 12, and throttle, 22, which feed charge air to a number of inlet runners, 14. Inlet runners 14 are operatively connected with a cylinder head mounting flange, 18, which is shown in FIG. 2 as being sealed to a cylinder head, 36, having a number ports, 37, formed therein, with ports 37 matching with runners 14 contained in intake manifold 10.

FIG. 1 further discloses cylinder head mounting flange 18 as having a cylinder head engaging surface, 20, which bears a sealing region, 26. Sealing region 26 includes a sealing composition 34 applied to a continuous groove, 30, which extends in a continuous loop about an outer periphery of mounting flange 18. Notice from FIG. 1 that there is no cross-linking of sealing region 26 extending between adjacent runners 14 within cylinder head engaging surface 20 of mounting flange 18. Accordingly, as noted above, there is no need to machine the areas between the adjacent ones of the runners to accommodate a cross-linking or ladder bar gasketing or sealing composition. As shown in FIG. 1, sealing region 26 passes inboard of a number of fastener apertures 46 formed in mounting flange 18, so as to prevent air leakage around fasteners.

Those skilled in the art will appreciate in view of this disclosure that the present charge air system could be rendered in several different materials commonly employed for automotive intake manifolds. These included, without limitation, metals, such as aluminum and magnesium, plastics, and composites. Although some plastics are subject to a creep phenomenon which could increase cross talk between adjacent runners by opening up the airflow crevice space between runners, it is believed that with commonly employed engineering plastics such an increase will have a negligible effect upon the induction tuning of an engine equipped with the present inventive system.

Figure 2:
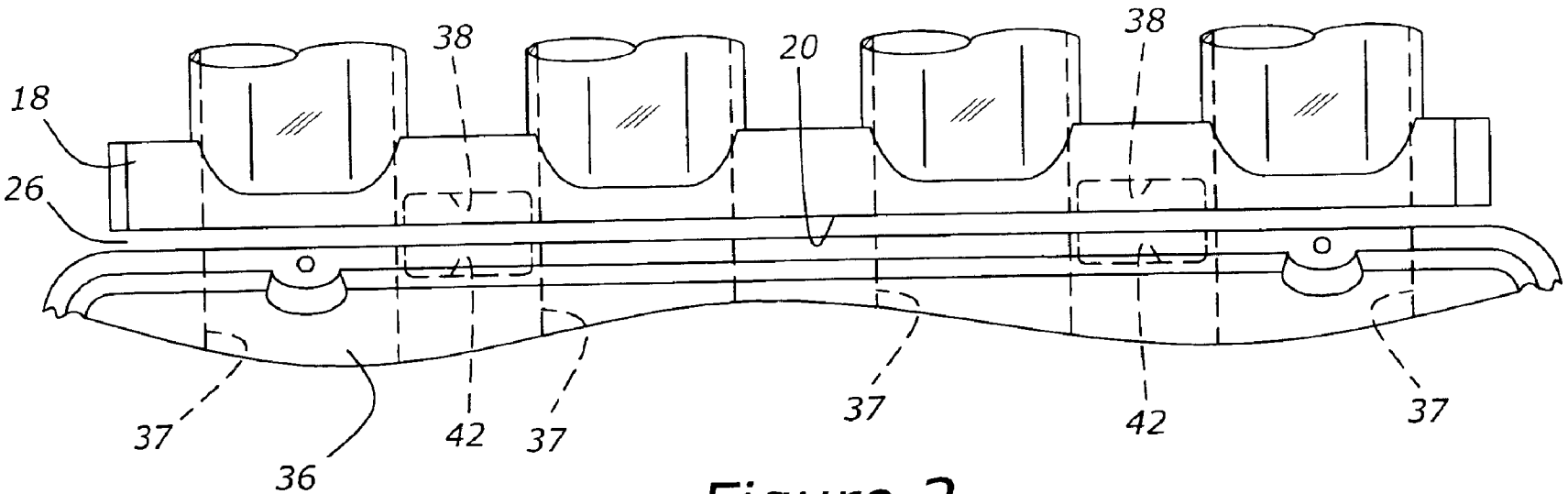
FIG. 2 is a partially schematic representation of a portion of an intake manifold and cylinder head according to an aspect of the present disclosure.

FIG. 2 shows two relief regions, with a first region, 38, formed in cylinder head mounting flange 18, and with a second relief region, 42, formed in cylinder head 36. In the interest of clarity, mounting flange 18 is shown as being separated slightly from cylinder head 36. In any event, those skilled in the art will appreciate in view of this disclosure that the precise configurations of relief regions 38 and 42 may be determined according to the precise architectures employed for cylinder head 36 and intake manifold mounting flange 18. What is important is that relief regions 38 and 42 save material, while also reducing cost and weight. This is possible because sealing region 26 is not cross linked and therefore does not extend through the contiguous space occupied by relief regions 38 and 42.

The foregoing system has been described in accordance with relevant legal standards, thus the description is exemplary rather than limiting in nature. For example, the present system may be employed between an upper and a lower intake manifold. This and other variations and modifications to the disclosed embodiment may become apparent to those skilled in the art and fall within the scope of the disclosure. Accordingly the scope of legal protection afforded can only be determined by studying the following claims.

What is claimed is:

1. An intake manifold for a multicylinder internal combustion engine, comprising:

a plurality of air inlet runners;

a mounting flange operatively connected with said runners;

a sealing region circumscribing only an outer periphery of said mounting flange; and a sealing composition applied as a continuous loop to an outer periphery of said mounting flange, whereby leakage of air past the mounting flange and into the engine will be prevented, while permitting air exchange between adjacent ones of said inlet runners.

2. An intake manifold according to claim 1, wherein said sealing region does not extend between adjacent ones of said runners.

3. An intake manifold according to claim 1, wherein said sealing region comprises a continuous groove formed in said mounting flange with said sealing composition applied to said groove.

4. An intake manifold according to claim 1, wherein said sealing region is configured as a continuous loop without cross-linking.

5. An intake manifold according to claim 3, wherein said sealing composition comprises a pre-formed elastomeric gasket.

6. An intake manifold according to claim 3, wherein said sealing composition comprises a formed in place elastomeric gasket.

7. An intake manifold according to claim 1, further comprising a throttle valve for controlling airflow through the manifold.

8. An intake manifold according to claim 1, wherein said mounting flange comprises a cylinder head mounting flange.

9. An intake system for an internal combustion engine, comprising:

a cylinder head;

an intake manifold mounted to said cylinder head, with said intake manifold having a plurality of air inlet runners and a cylinder head mounting flange connected to each of said runners;

a seal region extending between said cylinder head and a cylinder head engaging surface configured in said cylinder head mounting flange, with said seal region being configured as a continuous loop, without cross-linking;

a sealing composition applied as a continuous loop to an outer periphery of said mounting flange, whereby leakage of air past the mounting flange and into the engine will be prevented, while permitting air exchange between adjacent ones of said inlet runners.

10. An intake system according to claim 9, wherein said seal region comprises an elastomeric gasket compressed between said cylinder head and said cylinder head engaging surface.

11. An intake system according to claim 9, further comprising a plurality of relief regions configured in at least one of said mounting flange and said cylinder head, with said relief regions being positioned between adjacent ones of said inlet runners.

12. An intake system according to claim 9, wherein said seal region extends about a circumference of said cylinder head engaging surface, with said seal region extending inboard of a plurality of fastener apertures configured within said cylinder head mounting flange.

* * * * *